United States Patent [19]

Ellington

[11] 4,312,138

[45] Jan. 26, 1982

[54] CONTROL SYSTEM FOR FABRIC DRYING APPARATUS

[75] Inventor: David I. Ellington, Newton, Iowa

[73] Assignee: The Maytag Company, Newton, Iowa

[21] Appl. No.: 179,737

[22] Filed: Aug. 19, 1980

[51] Int. Cl.[3] ..... F26B 21/06

[52] U.S. Cl. ..... 34/45; 34/48; 34/53; 34/63; 34/133

[58] Field of Search ..... 34/48, 53, 63, 133, 34/44, 45

[56] References Cited

U.S. PATENT DOCUMENTS

| | | | |
|---|---|---|---|
| 3,381,389 | 5/1968 | Kurowski . | |
| 3,394,465 | 7/1968 | Janke | 34/53 |
| 3,398,461 | 8/1968 | Janke . | |
| 3,446,922 | 5/1969 | Vogt, Jr. . | |
| 3,471,938 | 10/1969 | Elders . | |
| 3,491,458 | 1/1970 | Elders et al. | 34/53 |
| 3,782,001 | 1/1974 | Cotton | 34/53 |

*Primary Examiner*—Larry I. Schwartz

*Attorney, Agent, or Firm*—Richard L. Ward

[57] ABSTRACT

A control system is provided for a fabric drying machine which includes both an automatic dry control and a timer mechanism. The timer mechanism includes operator movable actuators for positioning various timer switches. Machine cycles are controlled either entirely by the automatic dry control or partially by the automatic dry control and partially by the timer mechanism. In a particular cycle the control system functions to provide first a drying cycle controlled by the automatic dry control and then a secondary no-heat tumbling cycle controlled by the timer mechanism.

19 Claims, 7 Drawing Figures

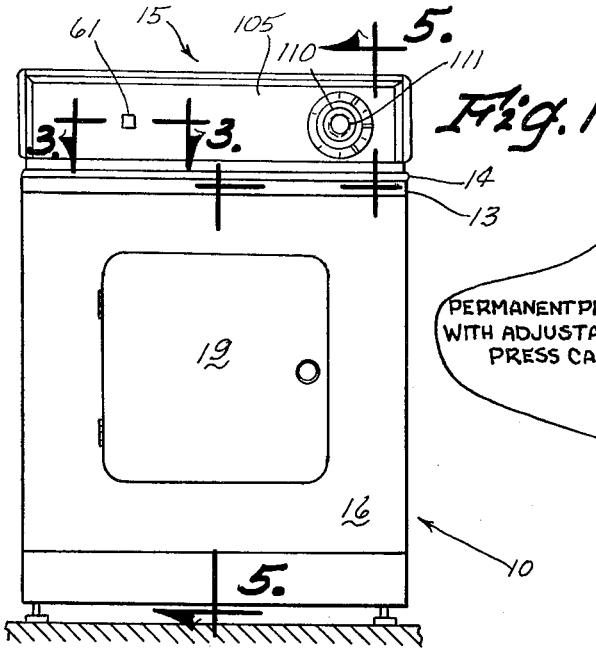
Fig. 1
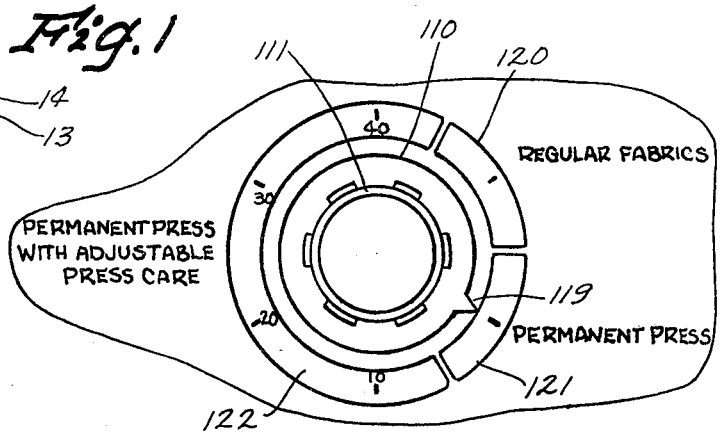
Fig. 2
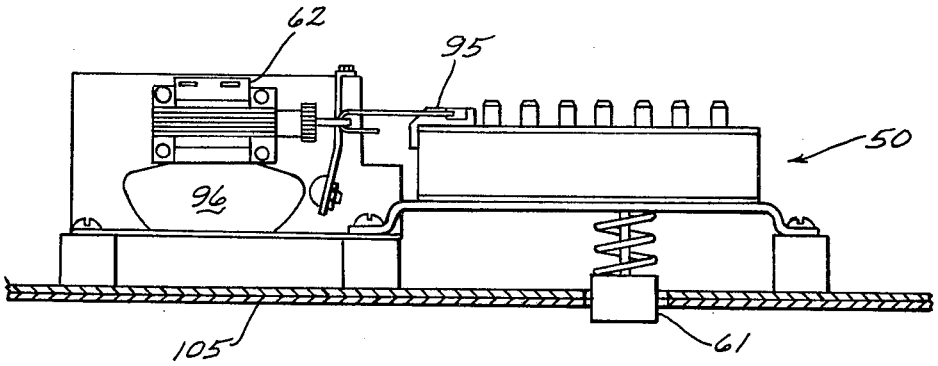
Fig. 3
| SWITCH | 51 | 52 | 53 | 54 | 55 | 56 | 57 | 58 |
|---|---|---|---|---|---|---|---|---|
| MOMENTARY SWITCH ACTUATED | X | X | O | X | □ | □ | O | O |
| SLIDE PULLED | O | O | X | O | O | O | X | X |
X CONTACT CLOSED
O CONTACT OPEN
□ MOMENTARY CLOSED
Fig. 4

| TIMER CAM CHART - 60 MINUTES PER REVOLUTION | | | |
|---|---|---|---|
| SW. | CAM | FUNCTION → | PERM PRESS WITH ADJUST CARE ← |
| 101 | 112 | DRIVE MOTOR | |
| 102 | 113 | TIMER MOTOR | |
| 103 | 114 | PRESS CARE CHIME | |
| 104 | 115 | PERM. PRESS CHIME | |

PERM. PRESS ← → REGULAR ←

CONTROL SYSTEM FOR FABRIC DRYING APPARATUS

BACKGROUND OF THE INVENTION

This invention relates generally to the field of fabric drying machines and more particularly to a control system for allowing operator selection of periods of no-heat tumbling following a cycle of operations.

In the field of fabric drying machines it is known industry practice to provide a cool-down period with no-heat tumbling following the determination that the fabrics, especially permanent press fabrics, are dry. It has also been found to be advantageous when drying permanent press fabrics to provide for some additional fabric care after the cool-down period to prevent the setting of wrinkles in the fabrics if the operator will not be available at the end of the normal cool-down.

To achieve this additional fabric care one system provides a control circuit operable for intermittently tumbling the fabrics for about ten seconds every five minutes through an impulse timer arrangement.

None of the known fabric drying machines provide a control system which allows the operator to select different timed periods of continuous no-heat tumbling upon termination of a permanent press cycle of operations utilizing a combined automatic dry control and manually adjustable timer mechanism with a cycle initiated by a manually operable momentary switch.

SUMMARY OF THE INVENTION

It is therefore an object of the instant invention to provide an improved control system for a fabric drying apparatus.

It is a further object of the instant invention to provide a control system utilizing a combined automatic dry control and manually adjustable timer operable for carrying out a plurality of selectable drying cycles.

It is a still further object of the instant invention to provide a control mechanism having a cycle selection dial with static positions for initiating selected automatic cycles as well as variable angular positions for achieving a timed extension of at least one cycle.

Briefly, the instant invention achieves these objects in a control system for a fabric drying apparatus including a rotatable fabric tumbler and heated airflow apparatus for drying fabrics in the tumbler and operable through a plurality of selectable cycles of operation. Control circuitry includes a timer having switches and sequentially advanceable cams for controlling actuation of the switches. The cams are operable for statically actuating at least a first portion of the switches at a first predetermined angular position and are further operable for sequentially actuating at least a second portion of the switches at other selective angular positions. The timer further includes timer drive mechanism energizeable for selectively driving the cams under control of at least one switch of the second portion of the switches. The timer is manually operable to selectively position the cams in either the first predetermined angular position or in one of the selective angular positions. The control circuitry is operable in the static first predetermined angular switch position for initiation of a first automatic dry control drying cycle and is operable in one of the other selective angular positions for initiation of a second cycle including a timed secondary tumbling cycle.

BRIEF DESCRIPTION OF THE DRAWINGS

The drawings illustrate a preferred embodiment of the invention with similar numerals referring to similar parts throughout the several views, wherein:

FIG. 1 is an overall view of a fabric drying machine incorporating the instant invention;

FIG. 2 is an enlarged view of the cycle selection dial portion of the control panel;

FIG. 3 is a view of the control switch assembly taken generally along lines 3—3 of FIG. 1 including the switch, solenoid and chime;

FIG. 4 is a chart indicating the operation of various switches included in the control switch of FIG. 3;

DESCRIPTION OF A PREFERRED EMBODIMENT

Figure 5:
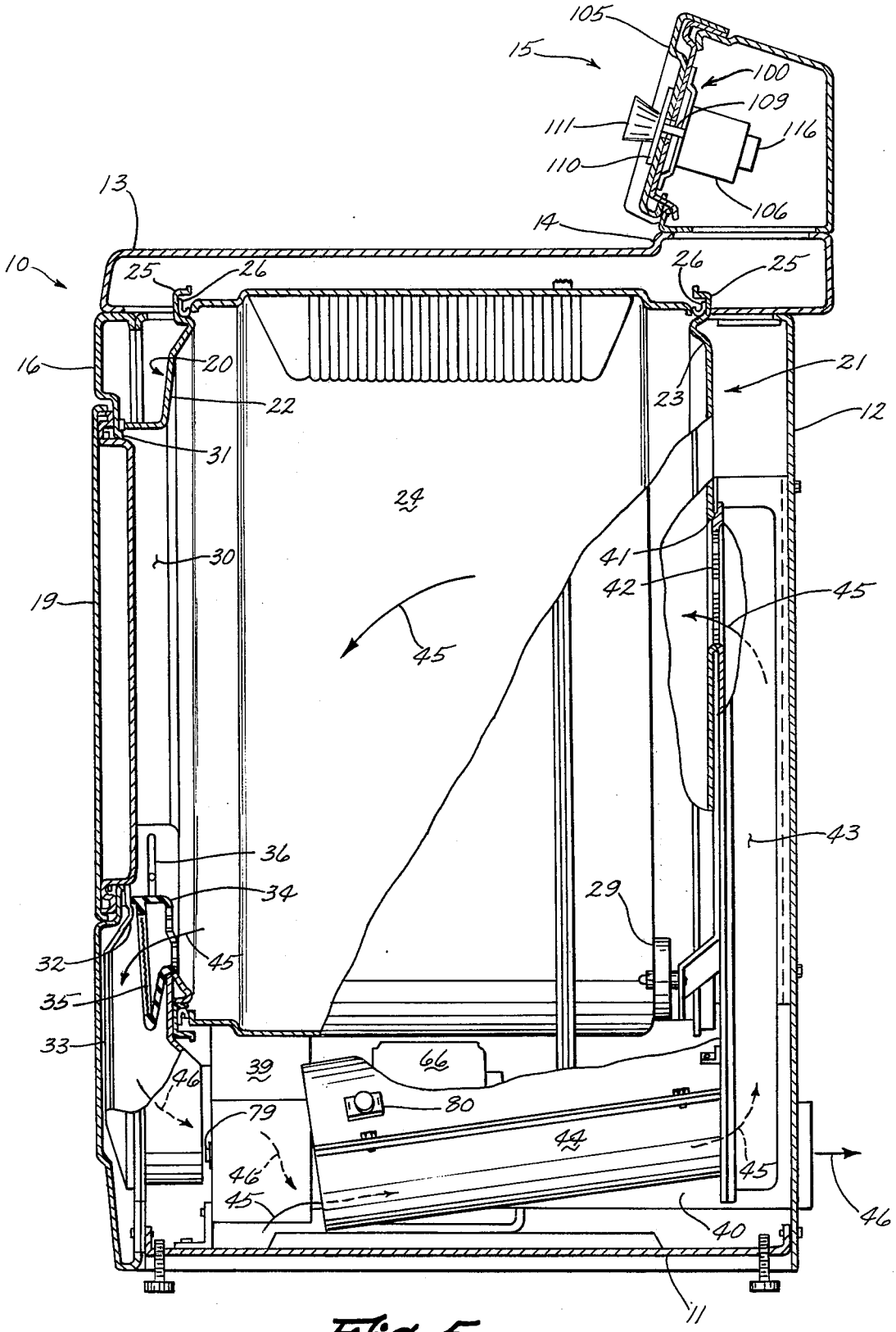
FIG. 5 is a sectional view of a fabric drying machine incorporating the control system of the instant invention and taken generally along lines 5—5 of FIG. 1.

Referring now to FIGS. 1 and 5 there is shown the overall construction for a fabric drying machine 10. A formed sheet metal base 11 provides a combination supporting and mounting surface for the cabinet structure of the machine 10. A three-sided cabinet wrapper 12 is secured to the base 11 and forms two sides and the rear of the fabric drying machine 10. A top cover 13 includes a riser portion 14 for mounting a control console 15 at its rear and the top cover-console assembly is secured to the top of the three-sided cabinet wrapper 12. A front panel 16 is secured to the cabinet wrapper 12 from the front and includes a hinged door 19 for providing access to the interior of the fabric drying machine 10.

As best shown in FIG. 5, front and rear stationary bulkheads 20 and 21 are secured to the cabinetry and form the front and rear walls 22 and 23 of the rotatable fabric tumbling dryer drum 24. The bulkheads 20 and 21 are each expanded outwardly to provide maximum drum 24 capacity. The rim or outer periphery 25 of the bulkheads 20 and 21 are formed to receive and retain resilient air seals 26 which seal the ends of the rotatable dryer drum 24 and the stationary bulkheads 20 and 21 to prevent outside air from leaking into the drum 24 due to the negative pressure therein when the drying machine 10 is running and to prevent moisture and fabrics from escaping the drum 24. This air seal construction is more particularly disclosed and claimed in U.S. Pat. No. 3,816,942 issued June 18, 1974 to Thomas R. Smith and assigned to the assignee of the instant invention.

As further shown in FIG. 5, the dryer drum 24 is mounted for revolution on a horizontal axis. The ends of the drum 24 are effectively closed by the stationary bulkheads 20 and 21 mounted within the cabinet. The drum 24 is cradled upon a pair of carbon-Teflon pads (not shown) adjacent to its front axis and near the four and eight o'clock positions, and by similarly disposed support rollers 29 at its back end. Both the pads and the support rollers 29 are carried by the front and rear bulkheads 20 and 21, respectively, and track upon the drum 24 at end portions of reduced cylindrical diameter.

The front bulkhead 20 has a central access opening 30 that is flanged outwardly for registration with a similar front panel opening 31 with its hinged access door 19. As viewed from the front, the bulkhead 20 at the access opening 30, from about the five o'clock to the nine o'clock position, is relieved to form a parallel-sided notch 32.

A duct 33 of molded plastic is arranged to cooperate with the notch 32 in the bulkhead 20. A lint screen retainer 34, with a removable lint screen 35, is of a width to conform to the access opening 30 flange on the bulkhead 20 and completes the circular integrity of the bulkhead 20. A handle or grip 36 is incorporated in this arcuate end portion. Internally, the lint screen retainer 34 has an opening covered by grillwork that is conformed to snugly fit the notch 32 in the bulkhead 20. The bulkhead filter assembly is disclosed and claimed in U.S. Pat. No. 3,789,514 issued Feb. 5, 1974 to Stewart W. Faust and L. D. Kuhn and assigned to the assignee of the instant invention.

An exhaust fan 39 is disposed on the sheet metal base 11 and has a duct 40 extending beneath the drum 24 to a point of discharge at the rear of the cabinet 12.

The rear bulkhead 21 has an air inlet opening 41 covered by a foraminous screen or grid 42 to prevent fabrics from entering into it. A flat duct 43 communicates with the air inlet opening 41 and extends downwardly to a point below the drum 24 and bulkhead 21 at the back of the cabinet 12. The duct 43 is provided with a front facing opening adjacent its bottom into which a heater assembly 44 is arranged to deliver heated air. The heater assembly 44 is energized in this embodiment by electricity. The heater assembly 44 is disclosed and claimed in U.S. Pat. No. 3,790,751 issued Feb. 5, 1974 to L. Dean Kuhn and assigned to the assignee of the instant invention.

When the exhaust fan 39 is actuated, ambient air as indicated by arrows 45 in FIG. 5 is drawn into the cabinet 12, through the heater assembly 44, upwardly through the flat duct 43 into the drum 24 through the air inlet opening 41 in the rear bulkhead 21. The air is withdrawn from the drum 24 through the grill in the lint screen retainer 34 below the access opening 30, passing downwardly through the lint screen 35 to the exhaust fan 39 from whence it is expelled rearwardly as shown by arrows 46 in FIG. 5 to the outer atmosphere via the exhaust duct 40 connected to the exhaust fan 39.

Referring to FIG. 3, there is shown in outline form a manually operable control switch 50. The control switch 50 includes a plurality of switches, as numbered 51 through 58 and actuatable between open and closed positions according to the chart of FIG. 4. The chart of FIG. 4 indicates the electrical posture of the switches 51–58 upon manual depression of the push-to-start button 61 and upon operation of the resetting solenoid 62.

Figures 6, 7:
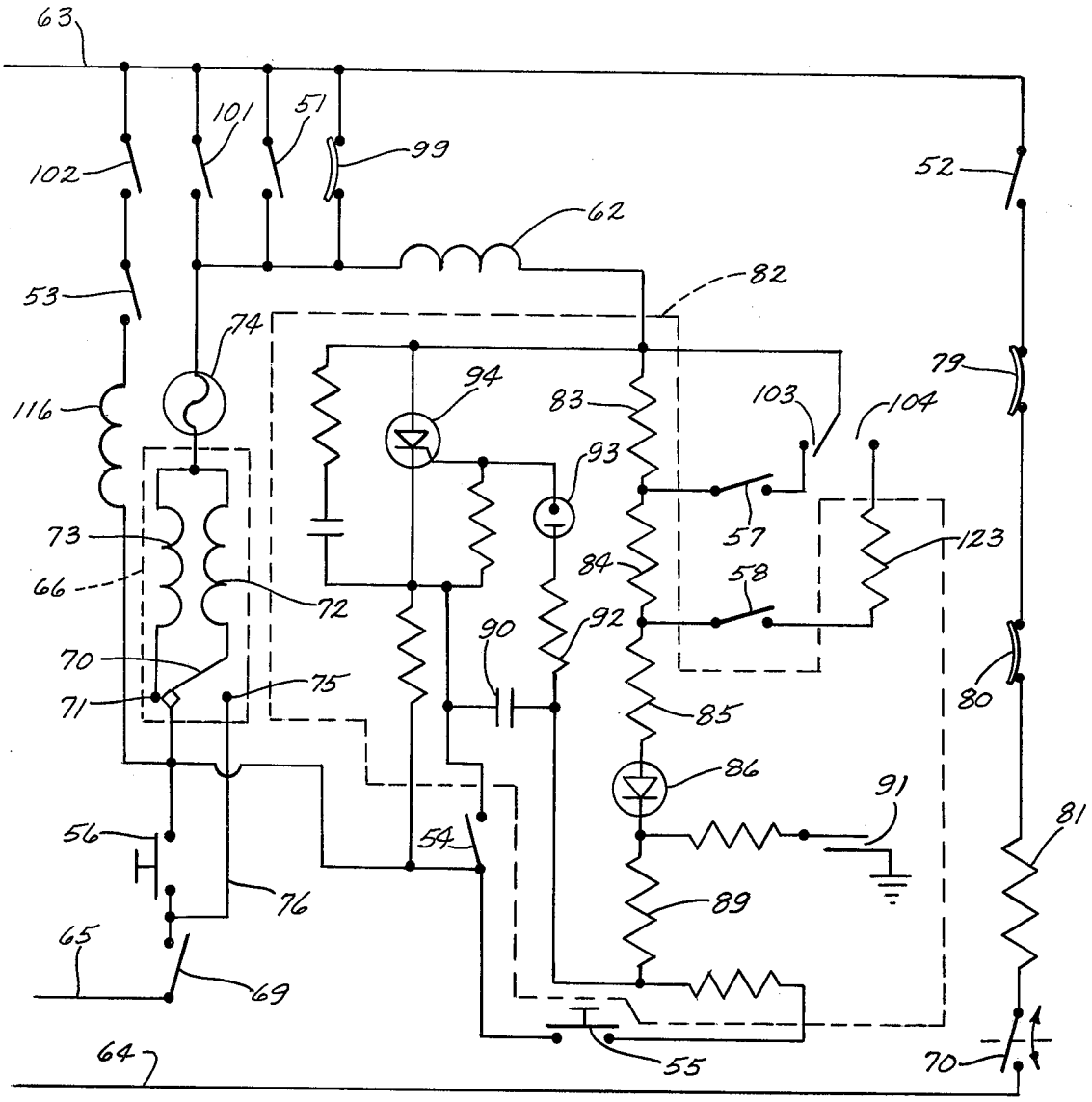
FIG. 6 is a schematic electrical circuit of the fabric drying machine including circuitry of the instant invention.
FIG. 7 is a timer cam chart relating to the electrical schematic of FIG. 6.

Referring now especially to FIG. 6, the control circuitry includes three conductors 63, 64 and 65 which are connectable with a conventional three-wire 240 volt, alternating current supply. For purposes of explanation of FIG. 6, it will be assumed that the conductors 63 and 64 are connected with the power lines and the conductor neutral 65 is connected to the earth grounded neutral line.

The energizing circuit for the drive motor 66 of the fabric drying machine 10 operates on 120 volts available between neutral 65 and conductor 63 or conductor 64 and includes a door switch 69 connected to the neutral conductor 65 and a manually operable momentary, single-pole single-throw switch 56 operated by the push-to-start button 61 shown in FIGS. 1 and 3. The energizing circuit for the drive motor 66 continues through the centrifugal switch 70 made to a normally closed contact 71 within the drive motor 66, through the run and start windings 72 and 73, through a thermal protector 74 and finally through switch 51, which is manually operable to a closed posture by depressing the push-to-start button 61 and to conductor 63.

Until the drive motor 66 rotates at a predetermined speed, the run and start windings 72 and 73 are both energized through the centrifugal switch 70 made to the normally closed contact 71, but upon operation of the centrifugal switch 70 to the normally open contact 75 the start winding 73 is disconnected from the circuit. After initial energization of the drive motor 66, operation of the centrifugal switch 70 to the normally open contact 75 and release of the push-to-start button 61, the circuit for energizing the drive motor 66 and maintaining energization thereof will be complete from the neutral conductor 65, through the door switch 69, through the conductor 76, through the normally open contact 75 of the centrifugal switch 70, through the run winding 72, through the thermal protector 74 and the switch 51 which remains closed upon release of the push-to-start button 61 and to conductor 63.

As further shown in FIG. 6 the heater circuit extends between power line conductors 63 and 64 and operates on 240 volts. The heater circuit includes a switch 52 incorporated within the control switch mechanism 50 and closed by depression of the push-to-start button 61 when starting the fabric drying machine 10, a regular temperature thermostat 79 mounted on the exhaust fan assembly 39, a high-limit thermostat 80 secured to the heater assembly 44, a heating element 81 and the centrifugal switch 70 located physically within the drive motor 66.

The control circuit of FIG. 6 includes an automatic dry control circuit 82 generally enclosed by dashed lines and described in U.S. Pat. No. 3,710,138 issued on Jan. 9, 1973 to Curran D. Cotton and assigned to the assignee of the instant invention. This automatic dry control 82 controls termination of fabric drying cycles through a resistance capacitance circuit operable for sensing the moisture of the fabrics.

As the drive motor 66 is energized and as it remains energized, the timing circuit of the automatic dry control 82 composed of resistor 83, resistor 84, resistor 85, diode 86, resistor 89 and capacitor 90 is also energized. When the fabrics are wet, their resistance is very low in comparison to the total resistance of the timing circuit. The wet fabrics are in series with a large total resistance composed of resistors 83, 84 and 85. The wet fabrics form the smallest resistance in the circuit; therefore, the voltage developed across the fabrics and the timing capacitor 90 is very small at the beginning of the drying cycle. As the fabrics become drier, their resistance becomes proportionately greater and an increasing voltage develops across the fabrics and the timing capacitor 90. The voltage across capacitor 90 is also developed across resistor 92 and the neon lamp 93; however, the neon lamp 93 will act as an open switch until the voltage across it reaches its "ignition potential". The neon lamp 93 will ignite when the resistances in the timing circuit and the resistance of the fabrics are of the proper proportion to permit the voltage developed across capacitor 90 to equal the "ignition potential" of neon lamp 93. At ignition, the neon lamp 93 becomes a much lower resistance than exhibited prior to ignition. This action permits the discharge of capacitor 90 through resistor 92 and the "gate" of the silicon controlled rectifier 94. The gate current causes the silicon controlled rectifier 94, which has been acting as an open switch during the drying cycle, to now act as a rectifier permitting the positive half-wave of the alternating line current to flow through the solenoid 62 and switch 51 to complete the circuit to conductor 63. Half-wave current will flow through the solenoid 62 for a sufficient length of time to permit the solenoid 62 to pull a slider 95 and mechanically reset the switches 51–58 within the control switch 50 to the postures indicated as "slide pulled" on the electrical switching chart of FIG. 4. The pulling or resetting action of the solenoid 62 on the slider 95 mechanically rings the end-of-cycle chime 96 shown in FIG. 3, breaks all current to the heater 81 by opening switch 52 and would deenergize the drive motor 66 by opening switch 51 except that the cool-down thermostat 99 has sensed sufficient temperature to cause it to close early in the drying cycle and its closed contacts will continue to energize the drive motor 66 until a predetermined lower temperature is reached.

The control system also includes a timer mechanism 100 having cam switches 101–104 as shown in FIG. 6 and closed or actuated by cams 112–115 respectively as indicated in the timer cam chart of FIG. 7. As best shown in FIG. 5, the timer mechanism 100 is secured to the rear of the control panel 105 with the timer body 106 projecting rearwardly into the control console 15 and the timer shaft 109 projecting forwardly through the control panel 105 for mounting of the cycle selector dial 110 and knob 111.

FIGS. 1, 2 and 5 each show the cycle selector dial 110 and knob 111 with the knob 111 operable for manually rotating the timer shaft 109 and the selector dial 110 to position the timer cams 112–115 mounted on the timer shaft 109 in postures for actuating the corresponding timer switches 101–104 to set the various drying cycles. As indicated in FIG. 2, three cycle selections are possible: regular fabrics, permanent press and permanent press with adjustable press care. The regular fabrics setting 120 is a static setting of the dial 110 with no energization of the timer motor 116 and therefore no movement of the dial 110. The permanent press setting 121 is at least partially a static setting with only brief energization of the timer motor 116 during the cool-down portion of the cycle to generally center the dial pointer 119 on the permanent press mark. In the permanent press with adjustable press care cycle, the timer motor 116 is actuated when the solenoid 62 pulls the slider 95 of the control switch 50 at the end of the drying portion and closes switch 53 as indicated in the chart of FIG. 4. The timer motor 116 will sequentially actuate the timer switches 101–104 as it rotates the timer shaft 109 and dial 110 through the operator selected time portion of press care and back toward the permanent press mark.

The use herein of the terminology "static setting" means that the timer motor 116 is not actuated during the cycle and there is no movement of the dial 110. Likewise, the term "sequentially actuate" means that the timer motor 116 is actuated to sequentially advance the timer cams 112–115 to actuate the timer switches 101–104 and to rotate the dial 110.

The timer cam chart of FIG. 7 indicates by shaded areas when the timer switches 101–104 corresponding to the timer cams 112–115 have been closed. The timer motor 116 is not energized until after the fabrics are dry and the solenoid actuator 62 pulls the slider 95 to reset the switches 51–58 within the control switch 50 thereby closing switch 53. As indicated in FIG. 7 the timer motor 116 is then operable for sequentially advancing cams 112–114 during the adjustable press care portion of the permanent press with adjustable press care cycle and is also operable for advancing cams 112, 113 and 115 during the first part of the cool-down portion of the permanent press cycle. If allowed to advance completely through the adjustable press care portion of the permanent press with adjustable press care cycle the timer motor 116 will rotate the knob 111 so that the dial pointer 119 will stop at the general location of the permanent press mark on the permanent press setting 121. In the cool-down portion of the permanent press cycle the brief energization of the timer motor 116 will generally center the dial pointer 119 on the permanent press mark if the pointer 119 had been set clockwise of the mark when initially setting the cycle.

Operation of the control system can best be understood by describing the operation of the three cycle possibilities. For the regular fabrics cycle of operations, the operator sets the timer dial pointer 119 anywhere within the dial segment 120 indicated as regular fabrics. In the cam chart of FIG. 7 the shaded areas of the chart indicate when the timer cam switches 101–104 are in the closed posture. As shown, a regular fabric cycle does not involve the closure of any of the timer cam switches 101–104 as the operator sets the timer dial pointer 119. The fabric cycle is controlled completely by the automatic dry control circuit 82 and by the cool-down thermostat 99. As shown in FIG. 4, when the push-to-start button 61 is depressed, switches 51, 52 and 54 are closed as well as momentary switches 55 and 56 and the drive motor 66 and automatic dry control circuit 82 will be actuated. As the start winding 73 drops out and the centrifugal switch 70 actuates the run winding 72, the centrifugal switch 70 will also actuate the heating element 81.

Once the automatic dry control circuit 82 has sensed that the fabrics have been sufficiently dried, the solenoid actuator 62 will be energized to ring a chime 96 signalling the end of the drying cycle and will simultaneously pull the slider 95 associated with the control switch 50 which will reset the control switch 50 by opening switches 51, 52 and 54 while closing switches 53, 57 and 58 according to the chart of FIG. 4. The drive motor 66 will continue to run through the cool-down thermostat 99 which is in a parallel circuit connection with the switch 51. The cycle will terminate once the cool-down thermostat 99 opens. The closing of switches 53, 57 and 58 by the solenoid actuator 62 pulling the slider 95 of the control switch 50 has no effect on the drying cycle since, as previously mentioned, none of the timer cam switches 101–104 were closed when the operator set the timer dial pointer 119.

In the permanent press cycle of operations, the operator sets the dial pointer 119 within the permanent press segment 121. With the dial pointer 119 set in this posture, it can be seen from FIG. 7 that timer cams 112, 113 and 115 are overlapping and the corresponding switches 101, 102 and 104 are simultaneously closed. When the push-to-start button 61 is pressed by the operator, the drive motor 66, automatic dry control circuit 82 and the heating element 81 are energized. The basic fabric drying cycle is controlled by the automatic dry control circuit 82 as in the regular fabrics cycle of operations. When the automatic dry control circuit 82 senses that the fabrics are sufficiently dry it will energize the solenoid actuator 62 which will ring the end-of-cycle chime 96 and pull the slider 95 associated with the control switch mechanism 50 of FIG. 3 to reset the switches 51–58 as indicated in the switching chart of FIG. 4. The drive motor 66 will continue to be operated through the cool-down thermostat 99 as in the regular fabric cycle.

When the slider 95 is pulled following the permanent press cycle, switches 57 and 58 are closed. Timer cam switch 104 is already closed and the charging time of the timing capacitor 90, is changed from minutes to only a few seconds by eliminating resistors 83 and 84 from the charging path. Since a circuit is made to line conductor 63 through the cool-down thermostat 99, the timing circuit continues to operate, rapidly charging and discharging capacitor 90 until the cool-down thermostat 99 opens or until the access door 79 is opened to terminate the cycle. This revised charging path for capacitor 90 gates the silicon controlled rectifier 94 approximately every 30 seconds to ring the chime 96 and thus signal the operator that the fabrics are being cooled and should be removed from the drying machine 10.

If the operator selects the permanent press with adjustable press care cycle of operations, any selected timed length or duration of post-dry no-heat tumbling up to 44 minutes maximum may be set on the timer 100 by rotating the dial pointer 119 clockwise to the appropriate time setting in segment 122 as shown in FIG. 2. As in the regular and permanent press cycles, the fabrics will be dried under control of the automatic dry control circuit 82. Upon sensing the proper fabric dryness, control of fabric tumbling will be switched to the timer 100 by means of the solenoid actuator 62 pulling the control switch slider 95 to open switches 51, 52 and 54 and close switches 53, 57 and 58. The timer motor 116 will be energized through closed timer cam switch 102 and closed switch 53 to maintain operation of the drive motor 66 through a bypass circuit made up of timer cam switch 101. Thus the drive motor 66 will continue to be energized after the cool-down thermostat 99 opens and will run until the timer motor 116 opens timer cam switch 101 through timer cam 112 as shown in FIG. 7. During the press care tumbling the solenoid actuator 62 will be periodically reenergized through the charging path from timer switch 103, switch 57, resistor 84, resistor 85, diode 86, resistor 89 and capacitor 90 to ring a repeating chime 96 approximately every 5 minutes. As shown on the timer cam chart of FIG. 7, during about the last three minutes of no-heat tumbling the capacitor 90 charging path will transition from the timer cam 114 or timer switch 103 path to the timer cam 115 or timer switch 104 path to reenergize the chime 96 approximately every 30 seconds through the lower resistance permanent press charging path of resistor 123, switch 58, resistor 85, diode 86, and resistor 89. The timer dial 110 will be rotated counterclockwise by the timer motor 116 to generally return the dial pointer 119 to the permanent press mark at the end of the cycle.

All three of the possible cycle selections are considered to be of the auto-dry type in that each cycle is controlled by the automatic dry control circuit 82 until the fabrics are dry. Once the fabrics are dry the input of the heating element 81 is terminated and the fabrics will be tumbled for a cool-down period through the circuitry of the cool-down thermostat 99 or, as in the case of the permanent press with adjustable press care cycle, control of the no-heat tumbling is transferred to the timer 100.

If the operator should open the dryer access door 19 to remove the fabric load prior to the complete run-out of press care time a new adjustable press care cycle can be initiated without any additional manipulation of the dial 110. For example, if 30 minutes of press care had been selected and the fabrics were removed with 20 minutes showing on the timer dial 110, a new permanent press with adjustable press care cycle of operations could be initiated which would have 20 minutes of press care by merely depressing the push-to-start button 61.

As indicated on the timer dial 110 shown in FIG. 2 there are no "off" positions. An auto-dry cycle of operations can be initiated at any angular posture of the dial pointer 119 by depressing the push-to-start button 61.

It is thus seen that the described control provides an improved control system for a fabric drying apparatus including a combination automatic dry control 82 and mechanical timer system 100. The combination provides a system which allows operator selectable periods of press care and a system which is energizeable for initiation of a drying cycle at any posture of the dial 110. When in the adjustable press care cycle the timer 100 will terminate operation with the dial pointer 119 in the permanent press position whereby the operator may initiate a new permanent press cycle without any manipulation of the dial 110.

In the drawings and specification there is set forth a preferred embodiment of the invention and though specific terms are employed these are used in a generic and descriptive sense only and not for purposes of limitation. Changes in the form and the proportion of parts as well as the substitution of equivalents are contemplated as circumstances may suggest or render expedient without departing from the spirit or scope of this invention as defined in the following claims.

I claim:

1. A control system for a fabric drying apparatus including a rotatable fabric tumbler and heated airflow means for drying fabrics in said tumbler and operable through a plurality of selectable cycles of operation, the combination comprising: control circuit means including timer means having switch means and timer driven sequentially advanceable cam means for controlling actuation of said switch means, said cam means being manually settable to a first predetermined angular position for selection of a first cycle of operation and alternately being manually settable to a second angular position for selection of a second cycle of operation, said control circuit means further including means operable with said cam means located statically in said first predetermined angular position for initiating said first cycle of operation; and means for automatically terminating operation of said apparatus when the fabrics are dry, said control circuit means being operable with said cam means in said second position for initiating said second cycle of operation including an automatically terminated drying cycle portion and a selectable-length timed secondary tumbling cycle portion controlled by a timer driven sequential advance of said cam means from said second position.

2. A control system as defined in claim 1 wherein said control circuit means further includes manually operated momentary switch means for initiating operation of each of said selectable cycles of operation.

3. A control system as defined in claim 1 wherein said timer means further includes means for providing a selectively variable length timed secondary tumbling cycle portion.

4. A control system defined in claim 3 wherein said timer means includes drive means operable for advancing said cam means from said second angular position toward said first predetermined angular position at which position rotation of said fabric tumbler and operation of said timer means is terminated.

5. A control system for a fabric drying apparatus including a rotatable fabric tumbler and heated airflow means for drying fabrics in said tumbler and operable through a plurality of selectable drying cycles, the combination comprising: control circuit means including manually operable control switch means for initiating said drying cycles and an automatic dry control circuit for at least partially controlling said drying cycles, said control circuit means further including timer means having switch means and sequentially advanceable cam means for controlling actuation of said switch means, said timer means further including timer drive means energizable for driving said cam means during at least a portion of one of said drying cycles; and manually operable means for positioning said cam means in a static first predetermined angular position for initiation of a first drying cycle automatically terminated by said automatic dry control circuit when the fabrics are dry and further operable for selectively positioning said cam means in various other second angular positions for initiation of a second drying cycle including a selectable-length timed secondary tumbling cycle portion.

6. A control system as defined in claim 5 wherein said second drying cycle also includes an initial portion automatically terminated by said automatic dry control circuit when the fabrics are dry and wherein said manually operable control switch means is operable for initiating a drying cycle controlled by said automatic dry control circuit irrespective of the posture of said cam means.

7. A control system as defined in claim 5 wherein said automatic dry control circuit includes means for terminating operation of said heated airflow means and for energizing said timer drive means to initiate and control said secondary tumbling cycle portion.

8. A control system as defined in claim 7 wherein said means for terminating operation of said apparatus includes means for transferring control of said tumbler rotation from said automatic dry control circuit to said timer means for control of said secondary tumbling cycle portion.

9. A control system for fabric drying apparatus including a rotatable fabric tumbler and heated airflow means for drying fabrics in said tumbler and operable through a plurality of selectable cycles of operation including a permanent press drying cycle and a permanent press drying cycle modified by the addition of a selectable period of extended no-heat tumbling, the combinaton comprising: control circuit means including manually operable control switch means and timer means, said timer means including a plurality of switches and sequentially advanceable cam means for controlling actuation of said switches and further including timer drive means for advancing said cam means; manually operable means for positioning said cam means to a first selectable angular position corresponding to the beginning of said permanent press drying cycle or to a second selectable angular position corresponding to the desired period of extended no-heat tumbling included in said modified permanent press drying cycle, said control circuit means being operable in the first angular position of said cam means for initiating said permanent press drying cycle; and means for terminating operation of said apparatus upon completion of said permanent press drying cycle, said control circuit means being operable in the second angular position of said cam means to initiate said modified permanent press drying cycle, said termination means being operable in the second position of said cam means for terminating a drying cycle portion and energizing said timer drive means for initiating and controlling said extended no-heat tumbling cycle portion.

10. A control system as defined in claim 9 wherein said timer drive means is operable for advancing said cam means from one of said second selectable angular positions to said first selectable angular position at which position rotation of said fabric tumbler and operation of said timer drive means are terminated.

11. A control system as defined in claim 9 wherein said means for terminating operation of said apparatus includes means for providing an audible repeating signal.

12. A control system as defined in claim 11 wherein said timer means includes means for effecting a transition of said repeating signal from a first signal frequency to a second signal frequency during a final portion of said extended no-heat tumbling cycle portion.

13. A control system for a fabric drying apparatus including a rotatable fabric tumbler and heated airflow means for drying fabrics in said tumbler and operable through a plurality of selectable cycles of operation including a permanent press drying cycle and a permanent press drying cycle modified by the addition of a selectable period of extended no-heat tumbling, the combination comprising: control circuit means including timer means having switch means and sequentially advanceable cam means for controlling actuation of said switch means and further including timer drive means for sequentially advancing said cam means, said control circuit means further including an automatic dry control circuit for controlling at least a portion of each of said drying cycles and manually operable control switch means for initiating each of said drying cycles; manually operable means for positioning said cam means in a first angular position corresponding to the beginning of said permanent press drying cycle or in a second selectable angular position corresponding to the desired period of extended no-heat tumbling included in said modified permanent press drying cycle, said manually operable control switch means being operable in said first angular position of said cam means for initiating said permanent press drying cycle; and means included in said automatic dry control circuit for terminating operation of said apparatus upon completion of said permanent press drying cycle, said manually operable control switch means being operable in said second selectable angular position of said cam means to initiate said modified permanent press drying cycle with said termination means being operable for terminating the drying cycle portion and energizing said timer drive means to initiate and control said extended no-heat tumbling cycle portion.

14. A control system as defined in claim 13 wherein said means for terminating operation of said apparatus includes means for transferring control of said tumbler rotation from said automatic dry control circuit to said timer means for control of said extended no-heat tumbling cycle portion.

15. A control system as defined in claim 13 wherein said control circuit means includes a bypass circuit operable during said extended no-heat tumbling for maintaining rotation of said fabric tumbler.

16. A control system as defined in claim 13 wherein said means for terminating operation of said apparatus includes means for providing an audible repeating signal.

17. A control system as defined in claim 16 wherein said timer means includes means for effecting a transition of said repeating signal from a first signal frequency to a second signal frequency during a final portion of said extended no-heat tumbling cycle portion.

18. A control system as defined in claim 13 wherein said manually operable control switch means is operable for initiating a cycle of operations controlled by said automatic dry control circuit irrespective of the posture of said actuator means.

19. A control system for a fabric drying apparatus including a rotatable fabric tumbler and heated airflow means for drying fabrics in said tumbler and operable through a plurality of selectable cycles of operation including at least one auto-dry cycle and at least one auto-dry cycle modified by the addition of a selectable-length timed period of tumbler rotation without heat, the combination comprising: control circuit means including manually operable control switch means, an automatic dry control circuit, and timer means, said manually operable control switch means being operable for initiating operation of said apparatus, said automatic dry control circuit being operable for determining when said fabrics are dry, said timer means including a plurality of switches and rotary sequentially advanceable cam means for controlling actuation of said switches and further including timer drive means for sequentially advancing said rotary cam means for controlling said timed period, said rotary cam means being divided into a plurality of rotatable segments corresponding to the plurality of selectable cycles including one segment providing said modified auto-dry cycle and being manually presettable to select a particular cycle of operation, said manually operable control switch means being operable for initiating an auto-dry cycle irrespective of the position of said rotary cam means, said control circuit means including switching means for effecting deenergization of said heated airflow means and for initiating termination of operation of said apparatus when said rotary cam means is positioned for one of the unmodified auto-dry cycles and for deenergizing said heated airflow means and transferring control of said apparatus from said automatic dry control circuit to said timer means for control of said timed period when said cam means is positioned for a modified auto-dry cycle.

* * * * *

UNITED STATES PATENT AND TRADEMARK OFFICE

CERTIFICATE OF CORRECTION

PATENT NO. : 4,312,138

DATED : January 26, 1982

INVENTOR(S) : David I. Ellingson

It is certified that error appears in the above-identified patent and that said Letters Patent are hereby corrected as shown below:

| | |
|---|---|
| Cover Page: In the Heading and Item No. 75 | "Ellington" should be -- Ellingson -- |
| Col. 6, Line 31 | After "fabric" insert -- drying -- |
| Col. 9, Line 52 | After "for" insert -- a -- |

Signed and Sealed this

*Thirteenth* Day of *April 1982*

[SEAL]

*Attest:*

GERALD J. MOSSINGHOFF

*Attesting Officer*

*Commissioner of Patents and Trademarks*